United States Patent [19]

Harrison et al.

[11] Patent Number: 4,858,274

[45] Date of Patent: Aug. 22, 1989

[54] LIFT-OFF HINGE ASSEMBLY

[75] Inventors: Neil Harrison, Sutton Coldfield; Cliff R. R. Aitken, Hampton Magna; Ian Holloway, Stratford-upon-Avon, all of England

[73] Assignee: I. H. W. Engineering Ltd., United Kingdom

[21] Appl. No.: 111,750

[22] Filed: Oct. 21, 1987

Related U.S. Application Data

[63] Continuation-in-part of Ser. No. 897,136, Aug. 15, 1986, abandoned.

[51] Int. Cl.[4] ..... E05D 7/10

[52] U.S. Cl. ..... 16/265; 16/270

[58] Field of Search ..... 16/261, 262, 263, 265, 16/270

[56] References Cited

U.S. PATENT DOCUMENTS

| | | | |
|---|---|---|---|
| 158,987 | 1/1875 | Selden | 16/265 |
| 3,013,297 | 12/1961 | Ferry | 16/263 |
| 3,431,591 | 3/1969 | Betso | 16/265 |
| 3,729,772 | 5/1973 | Marchione | 16/82 |
| 4,043,000 | 8/1977 | Bunker | 16/128 R |

FOREIGN PATENT DOCUMENTS

| | | | |
|---|---|---|---|
| 332638 | 5/1903 | France | 16/265 |

*Primary Examiner*—Richard K. Seidel

*Attorney, Agent, or Firm*—Jones, Askew & Lunsford

[57] ABSTRACT

A lift-off hinge assembly including a first hinge leaf hingedly connected to a second hinge leaf, the hinge connection between the hinge leaves being defined by at least two hinge formations spaced apart along the pivot axis of the hinge assembly, each hinge formation including a hinge pin positioned on one hinge leaf and which is journalled in the other hinge leaf, the hinge pins of all the hinge formations being arranged to cooperate with their respective journal to enable the hinge pins to be simultaneously withdrawn from their respective journals by moving the hinge leaves apart along the pivot axis, the journal for each pin being defined by a continuously walled aperture in an arm formed on the hinge leaf.

10 Claims, 4 Drawing Sheets

LIFT-OFF HINGE ASSEMBLY

The present invention relates to a lift-off hinge assembly for use in hingedly attaching vehicle doors to the vehicle body.

During the assembly of a vehicle, it is desirous to attach doors to the vehicle body with hinge assemblies which enable the door to be correctly positioned by adjusting the position of the hinge leaves and thereafter enable the door to be removed by separating the hinge leaves. The door may then be remounted in its correct position by attaching the hinge leaves together again.

One type of such a hinge assembly is a lift-off hinge assembly wherein the hinge leaves are separated by relative movement axially along the pivot axis of the hinge.

In certain applications, it is desirable that such relative movement is as small as possible in order to prevent the door from hitting the surrounding body during the separation process.

In one type of lift-off hinge assembly a single hinge pin is provided with is rotatably held captive in a journal formed in one hinge leaf and is detachably secured to the other hinge leaf. The connection between the hinge pin and said other hinge leaf is usually formed by removable connection means such as bolts which have to be removed prior to separation of the hinge leafs. In this type of hinge assembly the connection means also serves to resist relative movement between the hinge pin and said other hinge leaf and so has to be capable of providing a positive connection which does not loosen in use. Removal of such connection means to separate the hinge leafs is undesirable since it can be a time consuming operation and involves the use of additional components which is inconvenient in a motor car assembly plant. However with this type of hinge assembly the hinge pin need not project far axially into said other hinge leaf and so after removal of the connection means a relatively short axial displacement is required for separation.

In addition, with this type of hinge assembly, the portion of the hinge pin which is rotationally held captive in said one hinge leaf can be relatively long and thereby provide a hinge assembly capable of hanging a substantial load such as a car door.

It is a general aim of the prevent invention to provide a car door hinge assembly which is separable by a relative small axial displacement along the hinge pin and which does not involve the use of connection means for detachably securing one hinge leaf to the hinge pin and which provides a hinge of sufficient strength to be capable of hanging a car door.

According to one aspect of the present invention there is provided a lift-off hinge assembly including a first hinge leaf hingedly connected to a second hinge leaf, the hinge connection between the hinge leaves being defined by at least two hinge formations spaced apart along the pivot axis of the hinge assembly, each hinge formation including a hinge pin positioned on one hinge leaf and which is journalled in the other hinge leaf, the hinge pins of all the hinge formations being arranged to co-operate with their respective journal to enable the hinge pins to be simultaneously withdrawn from their respective journals by moving the hinge leaves apart along the pivot axis, the journal for each pin being defined by a continuously walled aperture in an arm formed on the hinge leaf.

Preferably at least one hinge pin is provided with a removable stop which when mounted on the hinge pin prevents withdrawal of said hinge pin from its journal and thereby prevents separation of the hinge leaves.

Various aspects of the present invention are hereinafter described with reference to the accompanying drawings, in which.

Figure 1:
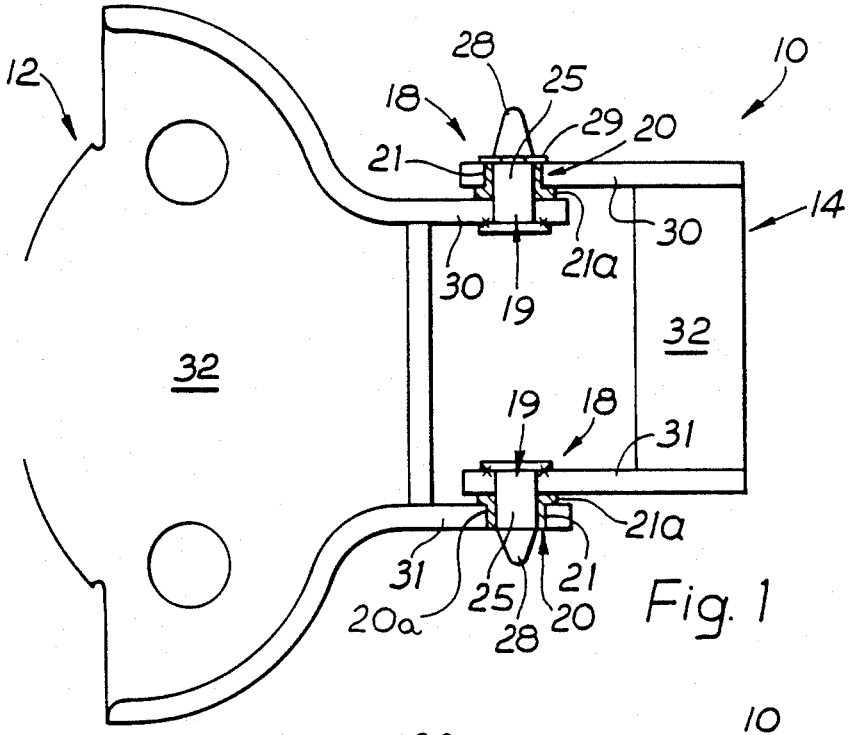
FIG. 1 is a schematic side view of one embodiment of the present invention.

Referring initially to FIG. 1 there is shown a lift-off hinge assembly 10 including a hinge leaf 12 which is hingedly connected to a hinge leaf 14. In the illustrated embodiment, the leaf 12 is in use attached to the vehicle body and the leaf 14 is attached to the vehicle door. The leaves 12, 14 are hingedly connected to one another by two hinge formations 18 which are spaced apart along the pivot axis of the hinge. Each hinge formation 18 includes a hinge pin 19 and a journal 20 for the associated pin 19; the pin 19 being mounted on one leaf and the journal being located on the other leaf. The pin 19 is preferably secured to its associated leaf by welding.

In the illustrated embodiment, each leaf is provided with one hinge pin 19 and one journal 20 but it will be appreciated that one leaf may be provided with both hinge pins whilst the other leaf may be provided with both journals.

The journal 20 is preferably formed by a bush 21 having self lubricating properties such as a metal reinforced plastics bush, the bush 21 being received in an aperture formed in the hinge leaf.

The bush 21 also has an annular flange **21*a*** which serves to slidingly space the hinge leaves apart.

In view of the fact that the hinge formations are spaced apart axially along the pivot axis of the hinge assembly short hinge pins may be used for supporting heavy loads. Thus the pin 19 has a constant diameter shank portion 25 which is preferably only long enough to protrude along the axis of the bush to provide an adequate pivotal connection; in the illustrated embodiment shank portion 25 protrudes along substantially the entire axial extent of the bush.

In addition in order to cope with high loadings imposed by the hinge pins on the adjacent bushes 21, the surrounding and supporting aperture **20*a* is formed by creating a bore through the respective arms 30, 31 such as for example by a drilling or stamping operation. This has the effect of creating a continuousy walled aperture 20*a* having a relatively short axial extent and yet is capable of withstanding relatively high loadings without distortion of the cross-sectional dimensions of the aperture. It will be appreciated that enlargement of apertures 20*a*** during use is highly undesirable since it would result in the hinge pins being able to move laterally within their journals.

The terminal end 28 of the pin 19 is preferably sharply tapered as shown in order to facilitate entry of the pin into an associated bush particularly during the remounting of a door onto a vehicle body.

The upper pin 19 is provided with an annular groove which houses a removable circlip 29 which acts as a stop to prevent withdrawal of the upper pin 19 from its associate journal 20 and thereby prevents axial separation of the hinge leave.

Figure 2:
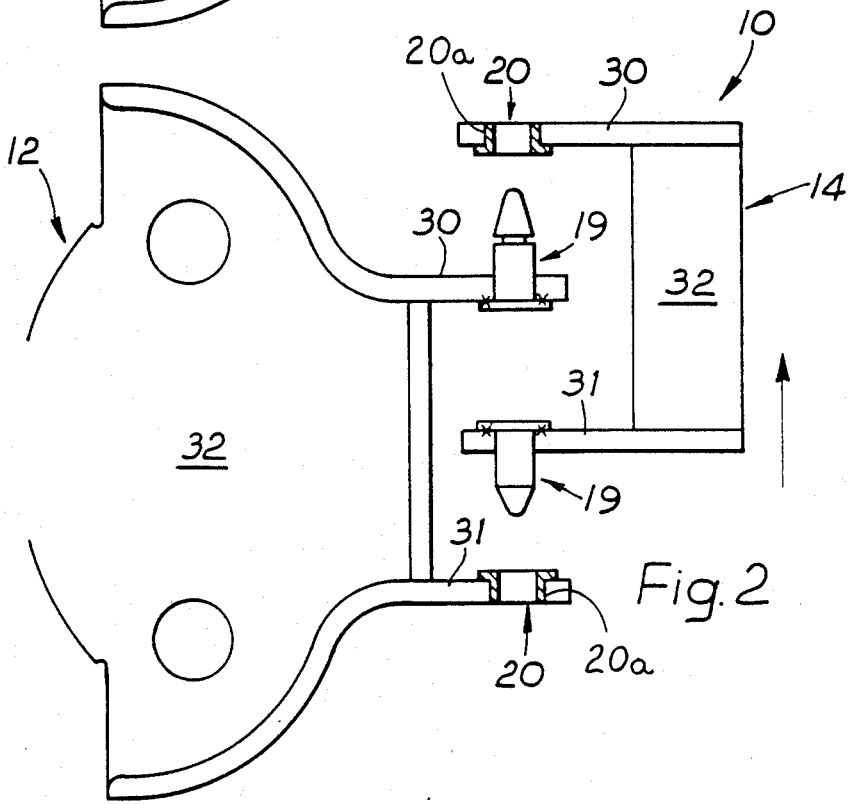
FIG. 2 is a similar view to FIG. 1 showing separation of the hinge leaves.

In order to separate the hinge leaves 12, 14, the circlip 29 is removed and the door (not shown) to which the leaf 14 is attached is raised sufficiently to withdraw the hinge pins from their associated journals. This situation is illustrated in FIG. 2.

The door may then be moved laterally away from the vehicle body.

The distance necessary for raising the door is only the length of the protruding shank portion 25 plus the terminal end 28.

The hinge leaves 12, 14 are both conveniently formed as metal pressings and are each provided with spaced apart arms 30, 31 and body portions 32. The arms 30, 31 are provided with hinge formations 18 and the body portions 32 are provided with suitable formations to enable the hinge leaves to be attached to the vehicle door/body.

It will be appreciated that more than two hinge formations may be provided spaced along the pivot axis. Additionally it is envisaged that the stop for preventing axial separation of the hinge leaves may be located on arms 30, 31 instead of pin 19.

Figure 3:
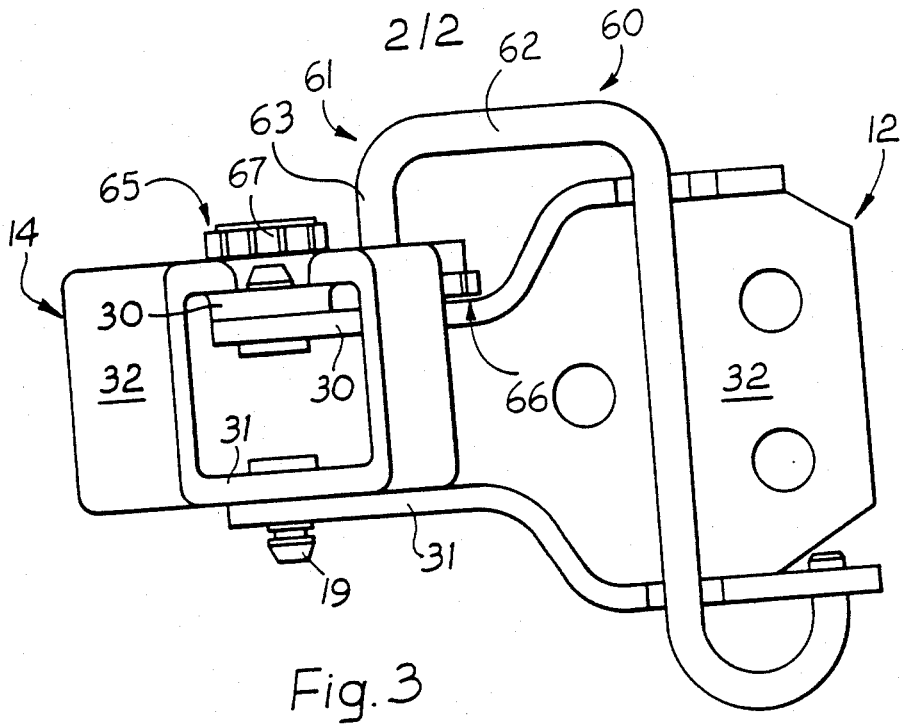
FIG. 3 is a side view of a further embodiment of the present invention incorporating a check mechanism.
Figure 4:
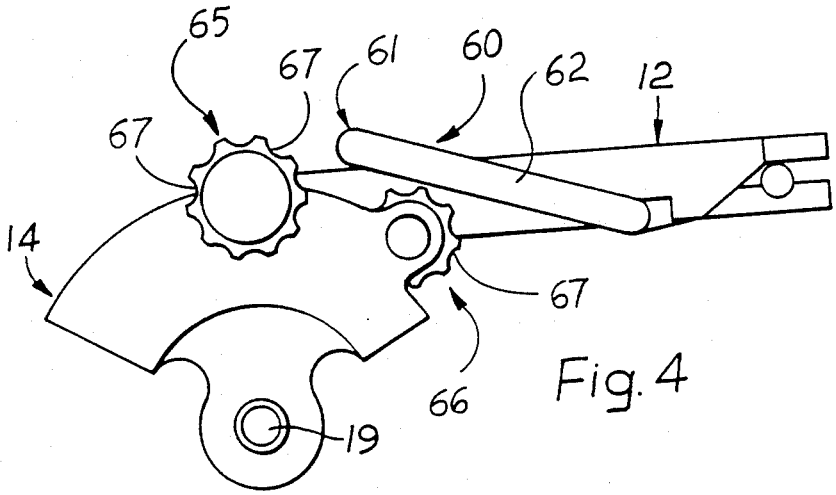
FIG. 4 is a plan view of the embodiment shown in FIG. 3.

In FIGS. 3 and 4 a further embodiment is illustrated wherein similar parts have been designated by the same reference numerals.

The embodiment shown in FIGS. 3 and 4 incorporates a check mechanism 60 which includes a detent 61 in the form of a length of bent resilient metal rod 62 mounted on leaf 12. The detent 61 includes a downwardly projecting arm portion 63 which on relative angular movement of the hinge leaves engages either with star wheel 65 or 66 both of which are rotatably mounted on hinge leaf 14. The portion 63 engages in a recess 67 formed in either star wheel 65 or 66 and on continued relative movement of the hinge leaves is deflected outwardly against the bias of the rod 62 and thereby resists said continued movement of the hinge leaves.

Figure 5:
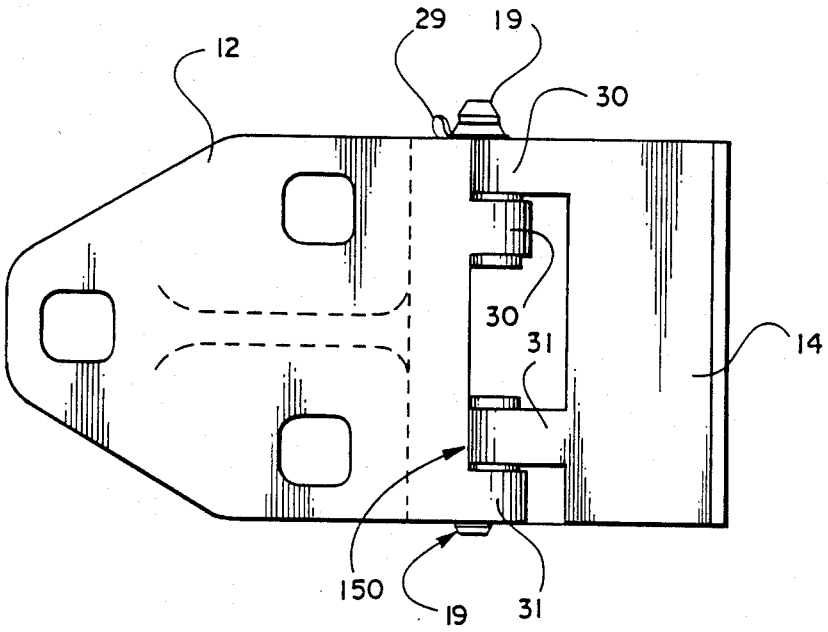
FIG. 5 is a side view of a second embodiment according to the present invention.
Figure 6:
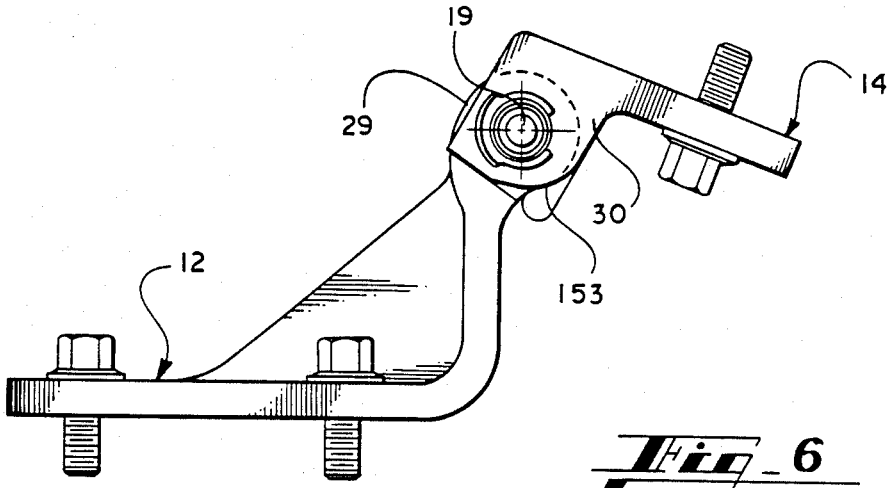
FIG. 6 is a plan view of the second embodiment.
Figure 7:
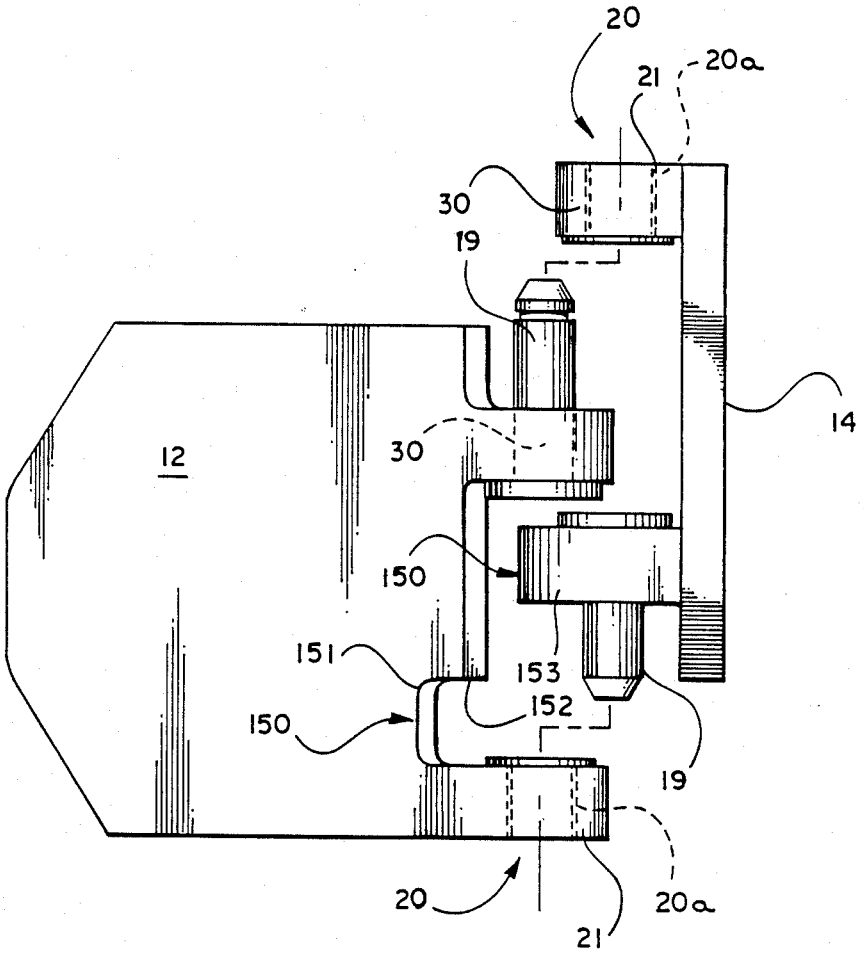
FIG. 7 is a further side view of the embodiment shown in FIG. 5 with the hinge leaves shown in a separated condition.

A further embodiment is illustrated in FIGS. 5, 6 and 7. In FIGS. 5 to 7 parts similar to parts shown in FIGS. 1 to 4 have been designated by the same reference numerals. In this embodiment the hinge leafs 12 and 14 are formed from metal castings and are adapted to interleaf such that over a predetermined range of relative angular displacement of the hinge leafs the interleafing formations 150 co-operate to restrain relative axial displacement of the hinge leafs. The predetermined range of relative angular displacement is chosen to be at least the range of angular displacement of the car door from its closed to its normal fully open position. If the door is moved beyond its normal fully open position and is usually permitted when the door check is removed, the interleafing formations 150 do not co-operate to restrain relative axial movement.

Having regard to FIG. 7, the interleafing formation on hinge leaf 12 takes the form of recess 151 which defines a shoulder 152. The interleafing formation on hinge leaf 14 is defined by an eccentric portion 153 formed on arm 31 of leaf 14. The eccentric portion 153 over said predetermined range co-operates with the shoulder 152 to restrain axial separation. Outside said range at a position, illustrated in FIG. 6, beyond the normal fully open position of the door the eccentric portion 153 is clear of said shoulder 152.

We claim:

1. A vehicle door lift-off hinge assembly comprising:

a first hinge leaf connected to a second hinge leaf for pivotal motion about a pivot axis;

each hinge leaf including a body portion from which extends a pair of oppposed arms spaced apart along the pivot axis;

each arm on one hinge leaf being connected by a hinge formation to a respective arm on the other hinge leaf;

each hinge formation including a separate hinge pin mounted on one arm and projecting therefrom to be received in a journal formed in the other arm;

the hinge pin passing through and being secured in a bore formed in said one arm and the journal being defined by a bush extending through a continuously walled aperture formed in said other arm; and the hinge pins of all hinge formations being located to cooperate with their respective journal to enable the hinge pins to be simultaneously withdrawn from their respective journals by moving the hinge leaves apart along the pivot axis.

2. A hinge assembly according to claim 1 wherein at least one hinge pin is provided with a removable stop which when mounted on the hinge pin prevents withdrawal of said hinge pin from its journal and thereby prevents separation of the hinge leaves.

3. A hinge assembly according to claim 1 or 2 wherein both the hinge leaves are pressings from a metal sheet.

4. A hinge assembly according to claim 3 wherein the axial extent of each aperture is the thickness of the metal sheet from which each hinge leaf is pressed.

5. A hinge assembly according to claim 4 wherein each pin has a protruding shank portion which in axial length is the same or less than the axial length of its associated journal.

6. A hinge assembly according to claim 5 wherein each pin has a tapered terminal end portion to facilitate entry of the pin into its associated journal.

7. A hinge assembly according to claim 1 wherein a check mechanism is mounted on both hinge leaves.

8. A hinge assembly according to claim 1 wherein both hinge leaves incorporate interleafing formations which co-operate to prevent axial separation of the hinge leaves whilst the hinge leaves are located within a predetermined range of relative angular positions.

9. A hinge assembly according to claim 1, wherein:

both the hinge leaves are pressings from sheet metal on planes substantially perpendicular to the pivot axis; and said continuously-walled aperture of each other arm extends through the sheet metal.

10. A hinge assembly as in claim 9, wherein said bushes have an annular flange extending on the sheet metal and receiving the sheet metal hinge leaves of said one arms, so as to slidingly space apart the hinge leaves.

* * * * *